United States Patent [19]

Kendall

[11] 4,235,132

[45] Nov. 25, 1980

[54] CAP TWISTER BOTTLE OPENER

[76] Inventor: Robert R. Kendall, Box 123, Troy, Pa. 16947

[21] Appl. No.: 70,151

[22] Filed: Aug. 27, 1979

[51] Int. Cl.[3] ..... B67B 7/00
[52] U.S. Cl. ..... 81/3.44
[58] Field of Search ..... 81/3.34, 3.4, 3.44

[56] References Cited

U.S. PATENT DOCUMENTS

| | | | |
|---|---|---|---|
| 431,086 | 7/1890 | Traut | 81/3.44 |
| 705,941 | 7/1902 | Marsh | 81/3.44 |
| 913,336 | 2/1909 | Westerbeck | 81/3.44 |
| 1,474,067 | 11/1923 | Buckwalter | 81/3.44 |
| 2,387,651 | 10/1945 | Densten | 81/3.44 |
| 2,523,544 | 9/1950 | Stamp | 81/3.44 |
| 2,630,031 | 3/1953 | Pank | 81/3.44 |
| 2,651,226 | 9/1953 | Hopmann | 81/3.1 |
| 2,729,125 | 1/1956 | Krzanowski | 81/3.46 |
| 3,817,126 | 6/1974 | Koebbeman | 81/3.44 |
| 3,913,424 | 10/1975 | Catillo | 81/3.44 |

FOREIGN PATENT DOCUMENTS

| | | | |
|---|---|---|---|
| 626407 | 9/1927 | France | 81/3.44 |

*Primary Examiner*—James G. Smith
*Attorney, Agent, or Firm*—Thomas Hooker

[57] ABSTRACT

A cap twister bottle opener having a pair of elongate clamp rings each having a transverse major axis and thick and thin circumferential portions surrounding a central opening. The rings are secured together by a pivot pin extending through the major axes and through the thin portion of one ring and the thick portion of the other ring. Cap-engaging teeth are provided on the interior surfaces of the thick portions of the rings for engagement with a cap inserted through the central openings. The bottle opener fits easily within the palm of the user and is squeezed to rotate the rings about the pin and move the teeth into engagement with the cap. The elongate shape of the rings facilitate rotation of the opener and held cap relative to the bottle to remove the cap from the bottle.

4 Claims, 6 Drawing Figures

CAP TWISTER BOTTLE OPENER

This invention relates to clamp-type bottle openers and of the type disclosed in U.S. Pat. Nos. 1,474,067, 3,817,126 and 3,913,424 and particularly to a hand-held bottle opener adapted to engage and open screw-type bottle caps. The opener is easily positioned around the bottle cap and includes two sets of teeth which are squeezed together so that the cap is engaged by the opener with the opener held in a stable position transverse to the vertical axis of the cap. The elongate geometry of the opener facilitates holding and rotating the opener and cap with respect to the bottle so that the cap is easily removed.

Other objects and features of the invention will become apparent as the description proceeds, especially when taken in conjunction with the accompanying drawings illustrating the invention, of which there is one sheet of drawings and one embodiment.

IN THE DRAWINGS

Figure 1:
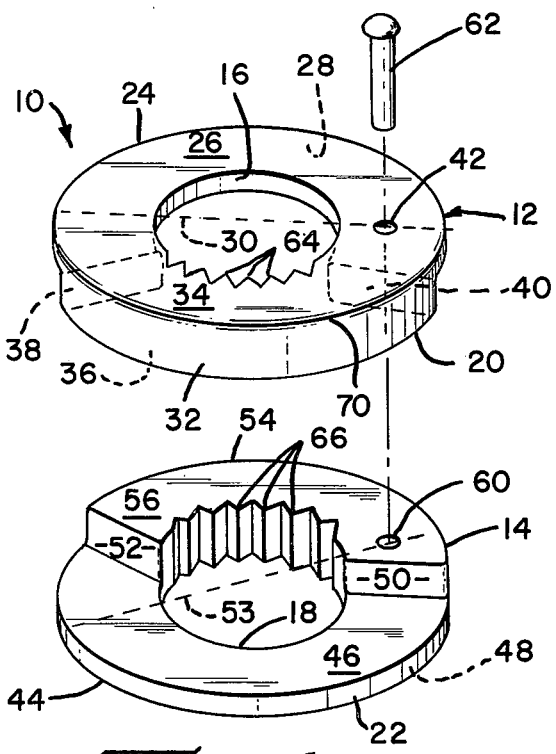
FIG. 1 is an exploded view of a bottle opener according to the invention.
Figure 2:
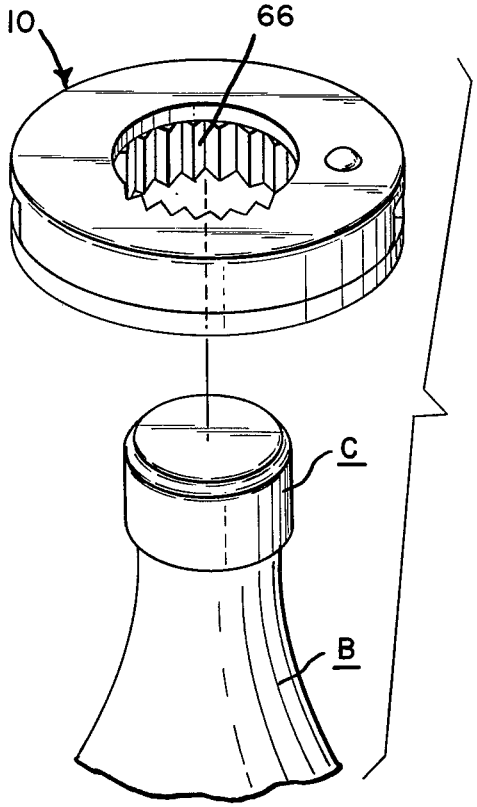
FIG. 2 is a prospective view illustrating the opener above and in position to be moved down around a bottle cap.
Figure 3:
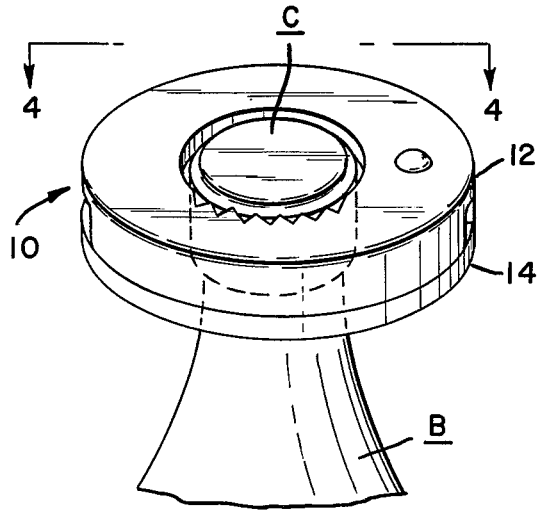
FIG. 3 illustrates the opener positioned around the cap.
Figure 4:
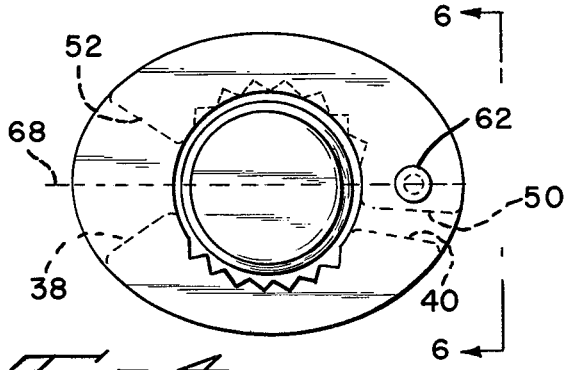
FIG. 4 is a top view taken along line 4—4 of FIG. 3.

Bottle opener 10 illustrated in the drawings includes a pair of like clamp rings 12 and 14 with each ring having a central generally-cylindrical opening 16, 18 and an oval or elongate outer surface 20, 22. Ring 12 includes a major thin circumferential portion 24 having flat upper and lower surfaces 26 and 28 and extending around the circumference of the ring on one side past the ends of major axis 30. An integral thick circumferential portion 32 joins the ends of portion 24 on one side of major transverse axis 30 and includes a flat upper surface 34 co-planar with surface 26 and a lower surface 36 parallel to but spaced below surface 28 a distance equal to the height of steps 38 and 40 located at the junctions between portions 24 and 32. The outer surfaces of portions 24 and 32 cooperate to form a generally oval surface 20 and the inner surfaces of portions 24 and 32 cooperate to form generally circular surface 16. A pin bore 42 lying on major axis 30 extends through the thin portion 24 adjacent step 40. The bore is perpendicular to the surfaces 26 and 28.

Clamp ring 14 includes a thin portion 44 having upper and lower surfaces 46, 48. Portion 44 extends around the circumference of the ring from step 50 adjacent one end of transverse major axis 52 around the ring, past the other end of the axis to step 52. Steps 50 and 52 define the circumferential extent of thick portion 54 having upper and lower surfaces 56 and 58. Thick portion 54 extends from the end of thin portion 44 at step 50 past major axis 53 and around the ring to step 52 located a short distance from the other end of the major axis. Pin bore 60 extends through thick portion 54 and lies on axis 53. The surfaces 46 and 56 parallel each other. Steps 50, 52 have the same height as steps 38 and 40 so that when the rings are assembled as in FIGS. 2 through 5, surface 28 is flush upon surface 56 and surface 36 is flush upon surface 46. The surfaces all parallel the axes of bores 42 and 60. See FIG. 6.

Figure 6:
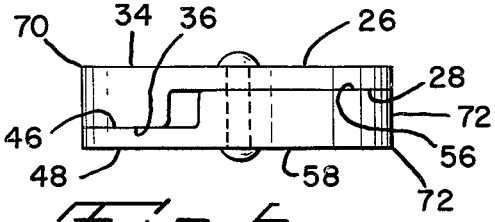
FIG. 6 is a view along line 6—6 of FIG. 4.
Figure 5:
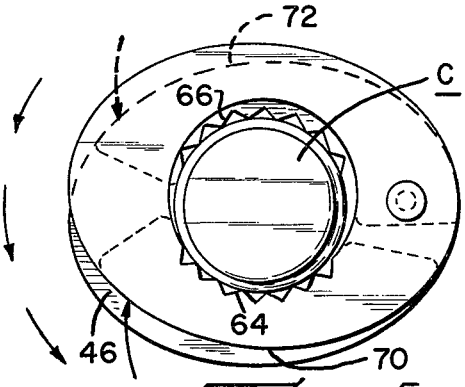
FIG. 5 is a view like FIG. 4 showing the rings of the cap of the opener moved into engagement with the cap whereby rotation of the opener will remove the cap from the bottle.

The clamp rings 12 and 14 are assembled by placing them together as illustrated and then inserting pin 62 through bores 42 and 60 so that the pin head rests flush on surface 26 and a suitable stop member is secured to or formed from the lead end of the pin for engagement with surface 58 as shown in FIG. 6. Suitable clearance is provided between shoulders 40 and 50 adjacent pin 62 and between shoulders 38 and 52 away from the pin to permit relative rotation of the clamp rings about the pin axis.

The interior surface of thick portion 32 is provided with a number of cap-engaging teeth 64 extending across the thickness of portion 32. The interior surface of thick portion 54 is provided with a number of like teeth 66 extending across portion 54.

Bottle opener 10 is preferably used for engaging and rotating threaded caps C secured to the tops of bottles B. The opener 10 is held in the hand of the user with the rings 12 and 14 positioned so axes 30 and 53 are one above the other and cylindrical openings 16 and 18 are above each other to define a single opening through the opener 10. In this position shown in FIG. 2, the clamp rings may be moved down over bottle cap C so that teeth 64 and 66 are located on opposite sides of the cap. See FIG. 3.

The opener is held in the hand of the user with the axis 68 extending across the user's palm. Closing of the palm on the exterior surfaces of the rings to either side of the major axis 68 brings the heel of the palm into engagement with the upper corner 70 and surface 20 of thick portion 32 and the ends of the fingers into engagement with the lower corner 72 and surface 72 of thick portion 54 to pivot the clamp rings together about pin 62 so that the teeth 64, 66 engage the surface of the cap C. With the elongate opener 10 held in the palm of the hand, it is then a simple matter to twist the hand thereby rotating the opener and clamped cap to remove the cap from the bottle B. See FIG. 5. The clearance between the adjacent pairs of shoulders in opener 10 permits closing of the opener to engage caps of different sizes. The teeth 64 and 66 extend the full height or thickness of the thick portions and overlap each other to stabalize the opener on the cap so that it extends generally perpendicular to the axis of the cap and thereby assures a proper engagement between the opener and cap during opening.

While I have illustrated and described preferred embodiment of my invention, it is understood that these are capable of modification, and I therefore do not wish to be limited to the precise details set forth, but desire to avail myself of such changes and alterations as fall within the purview of the following claims.

What I claim as my invention is:

1. A bottle opener comprising two elongate clamp rings each having a major transverse axis, a central cap-receiving opening and thick and thin circumferential portions extending around the opening, the circumferential ends of the thick portion defining steps extending above the thin portion at the junctions therebetween, all of said steps having approximately the same height; and a pin connection or the like joining the clamp rings for relative rotation of the rings, said connection having a rotational axis extending through the rings at the major transverse axis; one clamp ring including a thick portion extending in a first direction around the opening from a first step on one side of the major transverse axis, past the rotational axis to a second step located on the other side of the major transverse axis, the other clamp ring including a thick portion extending from a first step adjacent the first step of said one clamp ring circumferentially in a direction opposite said first direction around the opening to a second step, the rotational axis extending through the thin portion of the other clamp ring; cap-gripping means on the interior surfaces of said thick portions, said clamp rings being positioned one on top of the other so that the surfaces of said thick and thin portions to either sides of said steps abut each other and the central openings are generally aligned, whereby the openings in the clamp rings may be positioned over a bottle cap and thereafter the clamp rings may be closed and rotated to bring said cap-gripping means into engagement with the cap for subsequent removal.

2. A bottle opener as in claim 1 wherein the cap-gripping means comprise teeth on both said clamp rings extending across the width of said thick portions and past each other a distance approximately equal to the height of said steps.

3. The bottle opener as in claim 2 wherein said clamp rings are both generally oval in exterior configuration.

4. The bottle opener as in claim 3 wherein said pin connection includes a pair of bores extending through said rings and a pin permanently confined within said bores.

* * * * *